US005086852A

United States Patent [19]

van Buskirk

[11] Patent Number: 5,086,852

[45] Date of Patent: Feb. 11, 1992

[54] FLUID FLOW CONTROL SYSTEM FOR OPERATING A DOWN-HOLE TOOL

[75] Inventor: W. Jeffrey van Buskirk, Hobbs, N. Mex.

[73] Assignee: WADA Ventures, Hobbs, N. Mex.

[21] Appl. No.: 572,455

[22] Filed: Aug. 27, 1990

[51] Int. Cl.[5] ..... E21B 7/28

[52] U.S. Cl. ..... 175/269; 175/274

[58] Field of Search ..... 175/263, 265, 266, 267, 175/269, 271, 272, 273, 274, 279, 284, 285, 286, 287, 288; 91/3, 6; 92/2; 254/104; 137/625.34, 625.35, 625.24, 625.69; 166/55.3, 55.8

[56] References Cited

U.S. PATENT DOCUMENTS 2,976,927 3/1961 Kammerer, Jr. et al. .
3,005,507 10/1961 Clarke et al. .
3,018,788 1/1962 Perlis .
3,101,124 9/1963 Kammerer .
3,170,526 2/1965 Chauvin .
3,171,502 3/1965 Kammerer .
3,171,503 3/1965 Shirley .
3,196,961 7/1965 Kammerer .
3,200,894 8/1965 Brashear .
3,280,416 10/1966 Forsyth .
3,289,760 12/1966 Kammerer .
3,295,604 1/1966 Cordary et al. .
3,331,439 7/1967 Sanford .
3,339,647 9/1967 Kammerer, Jr. .
3,342,276 9/1967 Beck, Jr. .
3,347,323 10/1967 Sharp .
3,351,144 11/1967 Park .
3,356,167 12/1967 Trent .
3,386,521 6/1968 Chadderdon et al. .
3,406,769 10/1968 Kammerer, Jr. .
3,419,077 12/1968 Sanford .
3,425,500 2/1969 Fuchs .
3,439,697 4/1969 Blanchette et al. .
3,459,208 8/1969 Clyde .
3,496,587 2/1970 Dowling .
3,506,077 4/1970 Leathers et al. .
3,513,920 5/1970 Watson .
3,528,516 9/1970 Brown .
3,552,510 10/1970 Brown .
3,554,305 10/1970 Kammerer, Jr. .
3,561,550 11/1970 Mays .
3,568,784 11/1970 Kammerer, Jr. .
3,648,786 3/1972 Chenoweth .
3,656,564 4/1972 Brown .
3,684,041 8/1972 Kammerer, Jr. et al. .
3,731,753 5/1973 Weber .
3,749,187 7/1973 Leathers .
3,750,771 8/1973 Cugini .
3,756,331 9/1973 Okuyama et al. ..... 175/258
3,757,876 9/1973 Pereau .
3,757,877 9/1973 Leathers .
3,794,126 2/1974 Pereau .
3,799,276 3/1974 Matsushita et al. .

(List continued on next page.)

*Primary Examiner*—Ramon S. Britts
*Assistant Examiner*—Roger J. Schoeppel
*Attorney, Agent, or Firm*—Burns, Doane, Swecker & Mathis

[57] ABSTRACT

A fluid flow control and mechanical actuation system for controlling fluid flow in and mechanically actuating a tool includes an upwardly biased and vertically movable actuating assembly for actuating a tool upon downward movement. Two passages extend through the actuating assembly. A vertically and rotationally movable valve having a radially offset bore extending therethrough is also provided. The valve controls fluid flow to the two passages in the actuating assembly upon successive downward strokes of the valve so that when the bore in the valve is aligned with one of the passages in the actuating assembly, a pressure build-up occurs which is sufficient to cause the actuating assembly to move downwardly for actuating a tool. On the other hand, when the bore in the valve is aligned with the other passage in the actuating assembly, the build-up of pressure does not occur and the downward movement of the actuating assembly is prevented. The fluid flow control and mechanical actuation system can be used in conjunction with an underreamer as well as many other types of down-hole tools.

32 Claims, 4 Drawing Sheets

U.S. PATENT DOCUMENTS .

3,817,339 6/1974 Furse .
3,896,667 7/1975 Jeter ..... 175/40 X
3,924,652 12/1975 Kah, Jr. .
3,924,697 12/1975 College .
3,935,912 2/1976 Shibata .
3,938,598 2/1976 Watts .
3,949,820 4/1976 Furse .
4,023,629 5/1977 Watson .
4,031,972 6/1977 Burg .
4,051,767 10/1977 Landsberg .
4,055,226 10/1977 Weber .
4,064,951 12/1977 Weber ..... 175/45
4,068,711 1/1978 Aulenbacher .
4,071,098 1/1978 Dively et al. .
4,081,042 3/1978 Johnson et al. .
4,085,769 4/1978 van Haaften .
4,091,883 5/1978 Weber .
4,106,561 8/1978 Jerome et al. .
4,116,012 9/1978 Abe et al. .
4,119,151 10/1978 Smith .
4,169,510 10/1979 Meigs .
4,219,087 8/1980 Johnson .
4,270,618 6/1981 Owens .
4,282,941 8/1981 Perkin .
4,282,942 8/1981 Longmore .
4,316,635 2/1982 LeBegue et al. .
4,339,008 7/1982 Ford et al. .
4,354,560 10/1982 Johnson .
4,392,527 7/1983 Hauk et al. .
4,396,076 8/1983 Inoue .
4,401,171 8/1983 Fuchs .
4,401,172 8/1983 Kessler .
4,406,500 9/1983 Treuhaft et al. .
4,407,376 10/1983 Inoue .
4,411,324 10/1983 Liebig .
4,431,065 2/1984 Andrews .
4,436,167 3/1984 Masuda et al. .
4,461,361 7/1984 Fuchs .
4,488,606 12/1984 Inoue .
4,497,382 2/1985 Nenkov .
4,533,003 8/1985 Bailey et al. .
4,548,282 10/1985 Hurtz et al. .
4,589,504 5/1986 Simpson .
4,603,749 8/1986 Davis et al. .
4,610,578 9/1986 Frank et al. .
4,618,009 10/1986 Carter et al. .
4,629,011 12/1986 Reinhardt .
4,632,361 12/1986 Callison .
4,660,657 4/1987 Furse et al. ..... 175/269
4,690,166 9/1987 Howeth .
4,693,328 9/1987 Furse et al. .
4,715,440 12/1987 Boxell et al. .
4,809,793 3/1989 Hailey ..... 175/267 X Fig. 2
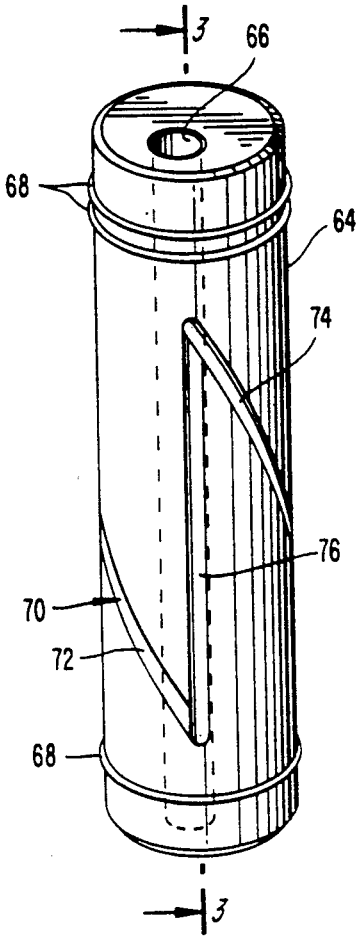
Fig. 4
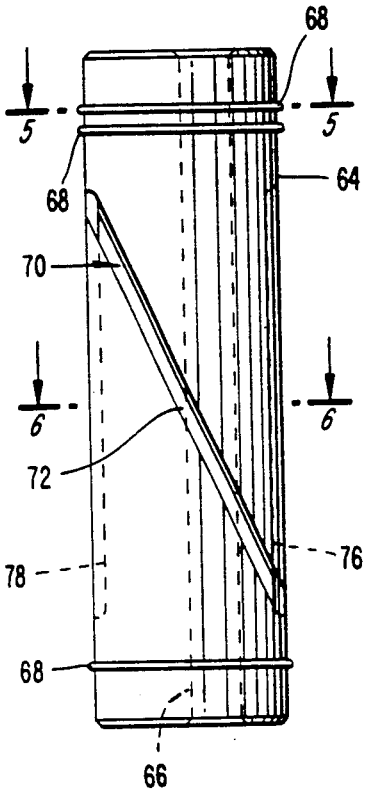
Fig. 3
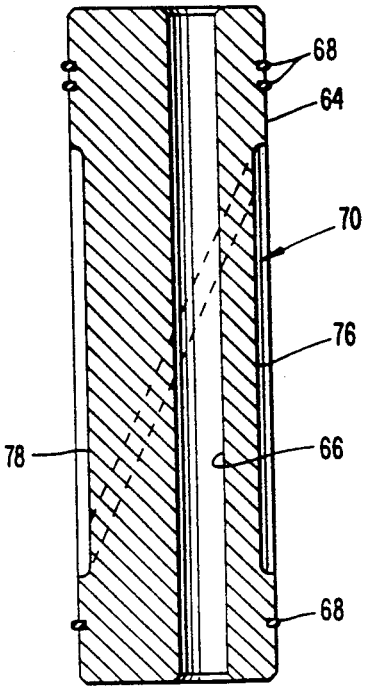
Fig. 5
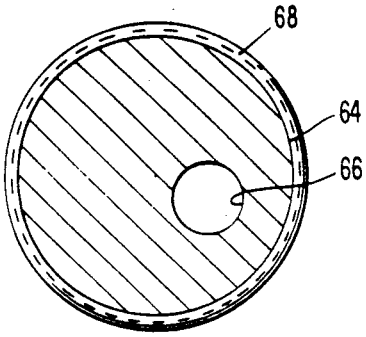
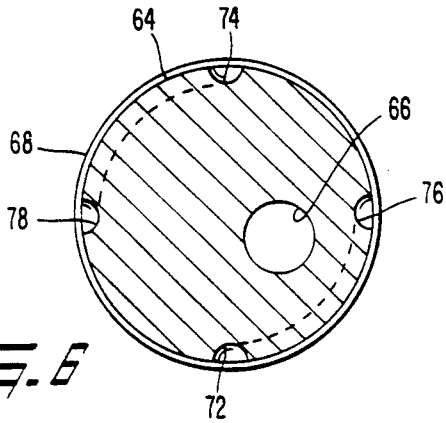
Fig. 6

FLUID FLOW CONTROL SYSTEM FOR OPERATING A DOWN-HOLE TOOL

FIELD OF THE INVENTION

The present invention relates to a fluid flow control and mechanical actuation system and more particularly, to a fluid flow control and mechanical actuation system for use, preferably, in down-hole tools for controlling fluid flow to and mechanically actuating various tool parts during down-hole operations.

BACKGROUND OF THE INVENTION

Drilling well bores for oil and gas exploration and recovery is known in the industry. During the initial formation of the well bore and even subsequent to the formation of the well bore, it is often desirable to perform various down-hole operations in the well. However, it can be difficult to readily control and carry out many of those down-hole operations due to the fact that the operator is located at the surface while the operations are being carried out several thousands of feet below the surface. For example, difficulties may arise with respect to mechanically actuating various parts of the tool located in the well bore. Similarly, it may be difficult to determine when the mechanical actuation has been completed. Also, controlling fluid flow to the tool parts may present certain problems for an operator located at the surface.

To illustrate some of the problems associated with down-hole tools, the construction and operation of one type of down-hole tool, an underreamer, will be discussed. Underreamers are used in the oil and gas industry to enlarge or drill-out the diameter of the well bore at any point along its length. Enlargement of the well bore may be necessary, for example, to provide space for cementing a liner in the bottom of the well. To effect drill-out of the well bore, the underreamer is inserted into the hole and the cutter arms which form a part of the underreamer are then extended outwardly while the underreamer is rotated. The rotating cutter arms contact and cut away the wall of the well bore and thereby enlarge the size of the well bore.

One problem associated with conventional underreamers is that fluid circulation through the tool cannot be carried out without also exerting a hydraulic pressure that extends the cutter arms to the extended or underreaming position. Consequently, fluid circulation and cutter arm extension cannot be performed independently of one another.

Another problem associated with conventional underreamers is the difficulty that arises in maintaining the cutter arms in the extended position during underreaming operations. If the cutter arms cannot be maintained at the extended position, the effectiveness of the underreamer is reduced and the underreaming operation, if successful, takes an unnecessarily long amount of time.

Conventional underreamers are also problematic in that the operator at the surface has no positive indication when the cutter arms have reached their fully extended position. The operator's inability to accurately determine when the cutter arms have reached their fully extended position means either that the underreamer must be removed from the well bore in order to determine the extent of the well bore enlargement or alternatively, the underreamer must be operated longer than is necessary to ensure that the cutter arms have been fully extended. In either case, valuable time is lost.

A further concern in the construction and operation of an underreamer involves the drilling efficiency of the cutting surfaces. If the drill cuttings are not removed from the cutting surfaces during the cutting operation, the drilling efficiency of the underreamer will be adversely affected.

OBJECTS AND SUMMARY OF THE INVENTION

In view of the aforementioned drawbacks associated with down-hole tools in general and underreamers in particular, it is an object of the present invention to provide a fluid flow control and mechanical actuation system in which a valve incorporated into the system serves a dual function of controlling fluid flow to two different passages in an actuation assembly and translating hydraulic back-pressure resulting when the valve is in alignment with one of the passages into a longitudinal mechanical force for actuating a part of the tool.

It is also an object of the present invention to provide a fluid flow control and mechanical actuation system in which the aforementioned valve can be operated by simply controlling a circulating pump that supplies fluid to the tool.

It is another object of the present invention to provide a fluid flow control and mechanical actuation system for a tool that is simple in construction and reliable in operation.

An additional object of the present invention is to provide a fluid flow control and mechanical actuation system for a tool that provides a positive indication to an operator on the surface that the mechanical actuation of a portion of the tool is completed.

Another object of the present invention is to provide an underreamer that is capable of maintaining the cutter arms in the fully extended position.

An additional object of the present invention is to provide an underreamer that can give a positive indication to an operator on the surface that the cutter arms are fully extended.

It is an additional object of the present invention to provide an underreamer that, in a first mode, permits fluid circulation through the tool while maintaining the cutter arms in their retracted position and that, in a second mode, permits hydraulic pressure to extend the cutter arms to the underreaming position while at the same time directing the circulating fluid through jets directed at the cutting face.

Still another object of the present invention is to provide an underreamer that is capable of keeping the cutting surfaces of the bit cones substantially free from cutting debris to thereby increase the cutting efficiency of the bit cones.

The foregoing objects as well as other objects that will become apparent from the description that follows are achieved through the fluid flow control and mechanical actuation system and the down-hole tool of the present invention. According to one aspect of the present invention, a fluid flow control and mechanical actuation system includes an upwardly biased and vertically movable actuating assembly for actuating a tool upon downward movement, and a vertically and rotationally movable valve. The actuating assembly includes two passages extending therethrough and the valve includes a radially offset bore extending therethrough for controlling fluid flow to the two passages in the actuating assembly upon successive downward strokes of the valve so that when the bore in the valve is aligned with one of the passages in the actuating assembly, a pressure build-up occurs which is sufficient to cause the actuating assembly to move downwardly for actuating a tool part, and so that when the bore in the valve is aligned with the other passage in the actuating assembly, pressure is released and the downward movement of the actuating means does not occur.

According to another aspect of the present invention, a hydraulically operated down-hole tool for use in well bores includes a body having a longitudinal bore that extends completely therethrough, a plurality of cutter arms pivotally mounted on a lower end of the body for movement between a retracted position and an extended position, and an axially movable wedge column positioned in the bore of the body. The wedge column has a longitudinal jet flow passage extending from one end of the wedge column to an opposite end and a flow through passage extending from one end of the wedge column to the opposite end. The flow through passage is larger in size than the jet flow passage and the lower end of the wedge column is adapted to interact with the cutter arms to cause the cutter arms to pivot outwardly to the extended position upon downward movement of the wedge column. A rotationally and axially moveable valve is positioned within the bore of the body at a point above the wedge column for alternately supplying fluid to the flow through passage and the jet flow passage and for translating hydraulic back-pressure which results when the valve supplies fluid to the jet flow passage into downward axial movement of the wedge column to cause the cutter arms to pivot outwardly.

According to an additional aspect of the present invention, a method of controlling fluid flow and mechanically actuating a tool part includes the steps of supplying fluid to a valve spool having a bore extending therethrough to cause the valve spool to move from a first position to a second position so that the bore is in alignment with a first passage in an actuator assembly, whereby the alignment of the bore and the first passage causes a build-up of pressure sufficient to cause downward movement of the actuator assembly to actuate a tool part, interrupting the supply of fluid to the valve spool to cause the valve spool to move from the second position to a third position, and restarting the supply of fluid to the valve spool to cause the valve spool to move from the third position to a fourth position in which the bore in the valve spool is in alignment with a second passage in the actuator assembly, whereby the alignment of the bore and the second passage prevents a build-up of pressure, thereby preventing actuation of the tool part.

According to still another aspect of the present invention, a down-hole tool for use in well bores includes a body having a bore extending therethrough, a plurality of cutter arms pivotally mounted on the body for movement between an extended position and a retracted position, an actuator assembly movably positioned in the bore in the body for actuating the cutter arms from the retracted position to the extended position upon downward axial movement of the actuator assembly caused by fluid circulating pressure, and an arrangement for producing a significant reduction in the fluid circulating pressure as the cutter arms move from the retracted position to the extended position to permit an operator to determine, based on the reduction in the fluid circulating pressure, when the cutter arms have reached a fully extended position.

BRIEF DESCRIPTION OF THE DRAWINGS

A preferred embodiment of the present invention will be described in greater detail with reference to the accompanying drawings, wherein like elements bear like reference numerals and wherein:

FIG. 2 is a perspective view of a preferred embodiment of the valve spool utilized in the underreamer and the fluid flow control and mechanical actuation system of the present invention;

FIG. 3 is a longitudinal cross-sectional view of the valve spool illustrated in FIG. 2 along the sectional line 3—3;

FIG. 4 is a side view of the valve spool illustrated in FIG. 2;

FIG. 5 is a cross-sectional view of the valve spool illustrated in FIG. 4 along the sectional line 5—5;

FIG. 6 is a cross-sectional view of the valve spool illustrated in FIG. 4 along the sectional line 6—6;

DETAILED DESCRIPTION OF THE PREFERRED EMBODIMENT

Figure 1:
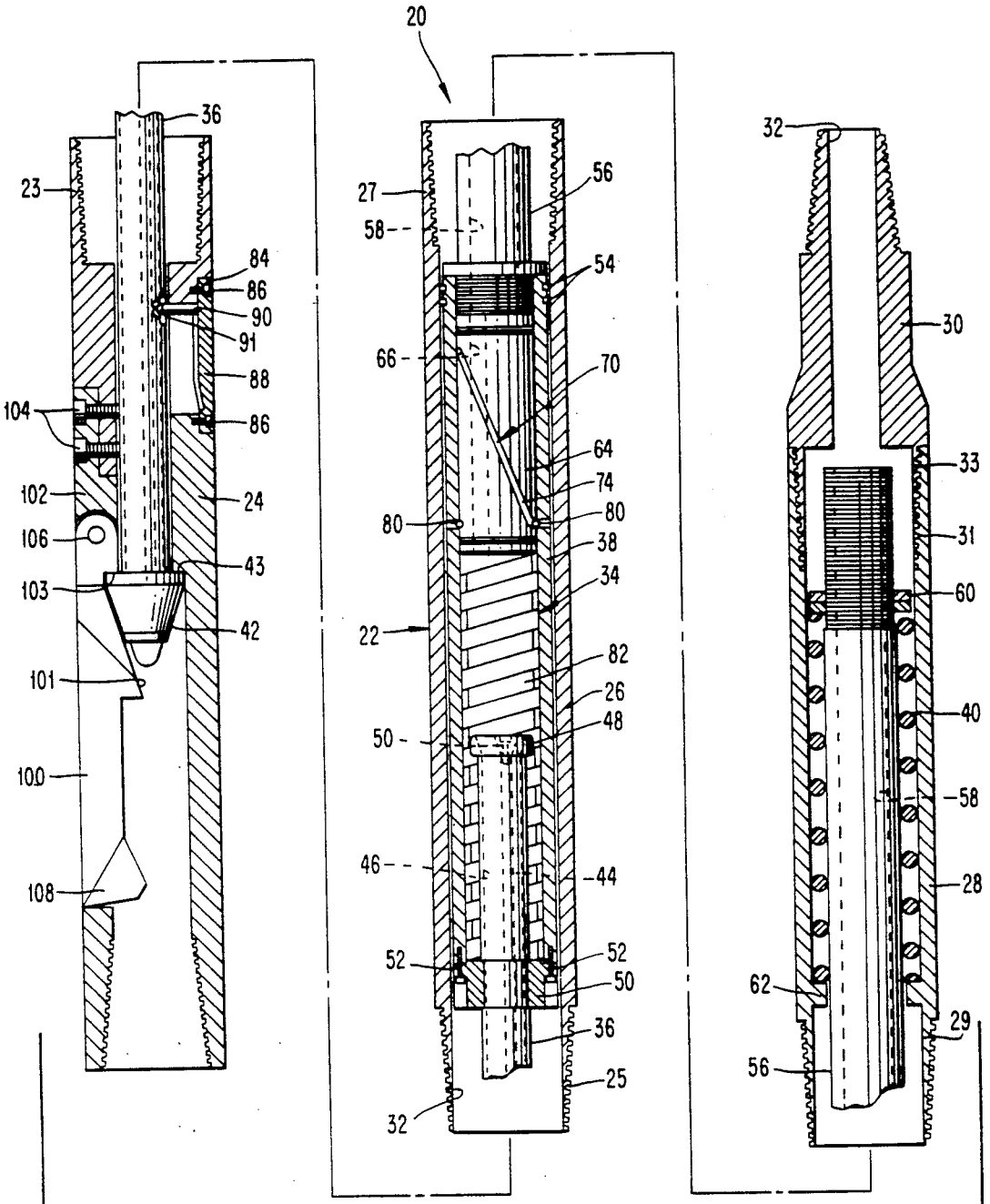
FIG. 1 is a longitudinal cross-sectional view of an underreamer according to the present invention.

The characteristics and features of the fluid flow control and mechanical actuation system according to the present invention and the indexing valve spool used to control the operation thereof will become apparent from the following description and the associated drawings. For purposes of illustration and understanding, the fluid flow control and mechanical actuation system and the indexing valve spool used for controlling the operation thereof will be shown and described as being used in conjunction with one particular type of down-hole tool, an underreamer. However, it is to be understood and it will become apparent from the description that follows that the indexing valve spool and the fluid flow control and mechanical actuation system disclosed herein are readily usable in conjunction with many other types of down-hole tools as well as other applications requiring fluid flow control and mechanical actuation.

In general, the underreamer 20 includes a body 22 having a plurality of cutter arms 100 pivotally mounted at a lower end thereof. An actuator assembly 34 is mounted within the body 22 for movement in the axial direction to contact and actuate the cutter arms 100 from the retracted position to the extended position. The actuator assembly 34 is biased upwardly within the body by a main return spring 40 and two passages 44, 46 extend through the actuating assembly 34.

A valve spool 64 is also positioned within the body 22 and is adapted to move axially and rotationally. An off-center bore 66 extends through the valve spool 64 and the valve spool 64 is biased upwardly by the force of a valve spool spring 82.

During operation, fluid is supplied to the underreamer to force the valve spool 64 to rotate and move axially downwardly so that the bore 66 in the valve spool moves into alignment with one of the passages 44 in the actuating assembly 34. That alignment causes a back-pressure to develop which forces the actuating assembly 34 to move downwardly, thereby actuating the cutter arms 100. When the supply of fluid is interrupted, the valve spool 64 moves axially upwardly with no rotational movement. Thereafter, when the supply of fluid to the underreamer is restarted, the valve spool 64 rotates and moves axially downwardly until the bore 66 in the valve spool 64 is in alignment with the other passage 46 in the actuator assembly 34. That alignment provides adequate relief of pressure to prevent downward movement of the actuator assembly 34 and actuation of the cutter arms 100. Thus, by briefly interrupting the circulation flow, well servicing personnel and operators can effect movement of the valve spool and selection of the desired underreamer mode.

In accordance with the present invention, the underreamer 20 includes, as seen in FIG. 1, an elongate, substantially cylindrical body 22 which is defined by a lower sub 24, a middle sub 26, a main return spring sub 28 and a top sub 30. The lower end 25 of the middle sub 26 is threadably connected to the upper end 23 of the bottom sub 24 while the lower end 29 of the main return spring sub 28 is threadably connected to the upper end 27 of the middle sub 26. Similarly, the lower end 33 of the top sub 30 is threadably connected to the upper end 31 of the main return spring sub 28. Other suitable connection means can, of course, be utilized to connect the subs 24, 26, 28, 30 to one another.

A bore 32 extends completely through the body 22 and consequently, through each of the subs 24, 26, 28, 30. Movably positioned within the bore 32 of the body 22 is an actuator assembly 34. The actuator assembly 34 includes a wedge column 36, a valve spool cylinder 38, and a main return spring 40.

The wedge column 36 includes a conically shaped wedge area 42 at the bottom end thereof for interacting with and actuating the cutter arms as will be described in more detail below. The larger diameter end of the conically shaped wedge area 42 forms a ledge 43 which engages the cutter arms of the underreamer in a manner that will become apparent later. The conically shaped wedge area 42 is positioned in the lower sub 24 of the body 22. The cylindrically shaped wedge column 36 extends upwardly through the bore 32 in the body 22 into the middle sub 26.

The wedge column 36 also includes a jet flow passage 44 and a flow through passage 46. The jet flow passage 44 and the flow through passage 46 extend completely through the wedge column 36 including the conically shaped wedge area 42. The jet flow passage 44 and the flow through passage 46 are radially offset with respect to and extend substantially parallel to the longitudinal axis of the wedge column 36. An adaptor plate 48 may be connected to the top end of the wedge column 36 by any suitable arrangement such as a screw 50. The adaptor plate 48 has passages extending therethrough that are aligned with the flow through passage 46 and the jet flow passage 44 respectively.

The diameter of the flow through passage 46 is larger than the diameter of the jet flow passage 44 for reasons that will become apparent when the operation of the tool is described. To give an example of the relative sizes of the flow through passage 46 and the jet flow passage 44, in an underreamer having an outside diameter of approximately $4\frac{5}{8}$ inches, the diameter of the flow through passage 46 may be approximately $\frac{3}{4}$ inch while the diameter of the jet flow passage 44 may be approximately $\frac{1}{2}$ inch.

The valve spool cylinder 38 is rigidly connected to the wedge column 36 so that the valve spool cylinder 38 and the wedge column 36 move together as a single unit. One way in which that rigid connection can be effected is by way of a two-piece split collar 50 which is positioned in a recessed outer surface portion of the wedge column 36. Standard set screws 52 or other suitable connection means can be utilized to anchor the two-piece collar 50 to the valve spool cylinder 38. Although not shown, the inner surface of one of the pieces of the two-piece collar 50 is provided with a keyway or slot. Similarly, the outer surface of the recessed portion of the wedge column cone 36 is also provided with a keyway or slot. Upon assembling the two-piece collar 50, a key is inserted into the keyway formed in the outer surface of the recessed portion of the wedge column 36 and the two-piece collar 50 is positioned such that the keyway in the collar receives the key. In that way, the two-piece collar 50 can only be positioned one way with respect to the wedge column 36.

The outer surface of the two-piece collar 50 and the outer surface of the valve spool cylinder 38 are also provided with one or more timing marks. During assembly, the timing mark(s) on the outer surface of the collar 50 is aligned with the timing mark(s) o the outer surface of the valve spool cylinder 38 to ensure proper rotational alignment of the collar 50 relative to the valve spool cylinder 38. The foregoing arrangement of keys, keyways and timing marks ensures that the wedge column 3 is positioned relative to the valve spool cylinder 38 in such a manner that the bore 66 in the valve spool 64 is properly aligned with either the jet flow passage 44 or the flow through passage 46 during successive downward strokes of the valve spool 64.

A suitable number of sealing rings 54 may be situated in annular recesses formed in the outer circumferential surface of the valve spool cylinder 38 to provide a seal between the outer surface of the valve spool cylinder 38 and the inner surface of the bore 32 in the body 22.

A main return spring mandrel 56 is secured to the top end of the valve spool cylinder 38. The outer surface of the lower end of the main return spring mandrel 56 may be threaded for threadably engaging internal threads located at the top end of the valve spool cylinder 38. A bore 58 extends completely through the main return spring mandrel 56. The main return spring mandrel 56 extends upwardly through the bore 32 in the body 22 and into the main return spring sub 28. Also, the upper end of the main return spring mandrel 56 is threaded on its exterior surface so that a spring retainer nut 60 can be adjustably positioned on the upper end of the main return spring mandrel 56. A shoulder 62 is integrally formed with and extends inwardly from the inner surface of the body 32 in the main return spring sub 28. The main return spring 40 is positioned between the shoulder 62 and the spring retainer nut 60 for biasing the actuating assembly 34 upwardly within the bore 32 of the body 22. The main return spring 40 surrounds the upper portion of the main return spring mandrel 56. Through adjustment of the spring retainer nut 60 in the axial direction along the upper end of the main return spring mandrel 56, the upward biasing force of the main return spring 40 on the actuator assembly 34 to be varied.

Positioned within the valve spool cylinder 38 is a valve spool 64. As seen more clearly in FIGS. 2–6, the valve spool 64 is substantially cylindrically shaped and has a bore 66 that extends completely through the valve spool from one end to the opposite end. The bore 6 extending through the valve spool 64 is radially offset with respect to the longitudinal axis of the valve spool 64. Moreover, the bore 66 extends substantially parallel to the longitudinal axis of the valve spool. A plurality of annular ring seals 68 are positioned in recesses formed in the outer circumferential surface of the valve spool 64 in order to provide a substantially fluid-tight seal with the inner surface of the valve spool cylinder 38.

A continuous groove 70 is formed in the outer surface of the valve spool 64. The continuous groove 70 includes two helically extending groove portions 72, 74 which are connected to one another at their ends by two longitudinally extending groove portions 76, 78. The depth of each groove portion 72, 74, 76, 78 varies from one end to the other so that each groove portion has, relatively speaking, a shallow end and a deep end. The groove portions 72, 74, 76, 78 are arranged such that the shallow end of one groove portion is positioned adjacent the deep end of the adjacent groove portion. Specifically, the shallow end of the longitudinal groove portion 76 is connected to the deep end of the helical groove portion 72, the shallow end of the helical groove portion 72 is connected to the deep end of the longitudinal groove portion 78, the shallow end of the longitudinal groove portion 78 is connected to the deep end of the helical groove portion 74, and the shallow end of the helical groove portion 74 is connected to the deep end of the longitudinal groove portion 76. As will become apparent from the description below, the foregoing arrangement of the groove portions 72, 74, 76 78 causes the valve spool 64 to move axially and rotationally in one specific manner in response to the presence or absence of fluid pressure.

As can be best seen in FIGS. 2 and 6, the longitudinal axis of the bore 66 extending through the valve spool 64 preferably does not lie in a plane parallel to and containing the longitudinal groove portions 76, 78. Rather, a plane containing the longitudinal axes of the bore 66 and the valve spool 64 intersects the plane containing the longitudinal groove portions 76, 78. That offset arrangement of the bore 66 helps contribute to maintaining the structural integrity of the valve spool 64 by ensuring that the thinnest part of the valve spool 64 is not aligned with the longitudinal groove portion 76. Alignment of the thinnest part of the valve spool 64 with the longitudinal groove portion 76 would cause the thinnest part of the valve spool 64 to be further reduced along a substantial portion of the length of the valve spool 64 by the depth of the longitudinal groove portion 76.

The valve spool 64 is mounted for axial and rotational movement within the valve spool cylinder 38. In the preferred embodiment two oppositely positioned spring-loaded locator balls 80 extend inwardly from the inner surface of the valve spool cylinder 38. The spring loaded locator balls 80 engage the continuous groove 70 formed in the outer surface of the valve spool 64 and serve to rotationally and axially guide the valve spool 64 in response to fluid pressure from above the valve spool 64. As an alternative to the spring-loaded locator balls 80, spring-loaded locator pins could be utilized for guiding the valve spool 64.

A valve spool spring 82 is positioned between the bottom surface of the valve spool 64 and the top surface of the two-piece collar 50 secured to the outer surface of the wedge column 36. The valve spool spring 82 surrounds the upper portion of the wedge column 36.

The bottom sub 24 of the body 22 includes a cutout portion 84 in which is positioned and secured by way of set screws 86 or the like, a guide 88. As seen most clearly in FIG. 8, the guide 88 has an outer surface 92 that is inclined away from the wedge column 36. The wedge column 36 is provided with a bore 91 into which is slidably positioned a jet stream restrictor valve plunger 90. The bore 91 that extends into the wedge column 36 intersects the jet flow passage 44 extending through the wedge column 36. Several annular seals can be positioned in grooves on the outer surface of the jet stream restrictor valve plunger 90 in order to provide a fluid-tight seal between the outer surface of the jet stream restrictor valve plunger 90 and the inner surface of the bore 91 that intersects the jet flow passage 44.

Figure 8:
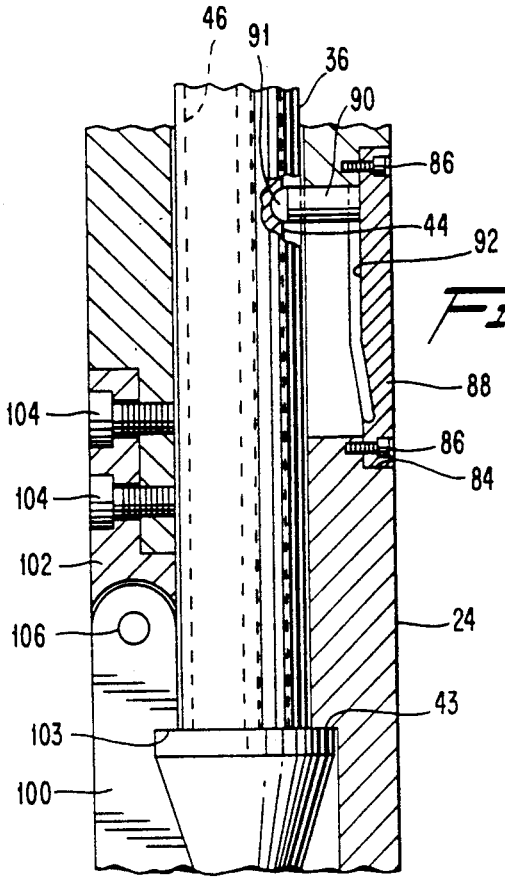
FIG. 8 is an enlarged view of a portion of the underreamer of the present invention showing the jet restrictor valve feature.

The length of the jet stream restrictor valve plunger 90 is selected such that when the wedge column is in its uppermost position as illustrated in FIGS. 1 and 8, the jet stream restrictor valve plunger 90 will extend into the jet flow passage 44 and restrict the flow of fluid through the jet flow passage 44. Preferably, the length of the jet stream restrictor valve plunger 90 should be such that the flow of fluid through the jet flow passage 44 is not completely cut-off when the wedge column 36 is in its uppermost position.

As a result of the foregoing construction, when the wedge column 36 moves vertically downwardly within the body 22 from the position illustrated in FIGS. 1 and 8, the end of the jet stream restrictor valve plunger 90 located farthest from the wedge column 36 will slide along the surface 92. As the wedge column 36 moves further and further downward, the inclined nature of the guide surface 92 will permit the jet stream restrictor valve plunger 90 to be retracted from the bore 91 that intersects the jet flow passage 44. When the jet stream restrictor valve plunger 90 is positioned as shown in FIGS. 1 and 8, the flow of fluid through the jet flow passage 44 is most restricted whereas when the jet stream restrictor valve plunger 90 reaches the bottom of the inclined surface 92, the flow of fluid through the jet flow passage 44 is substantially unrestricted.

Figure 9:
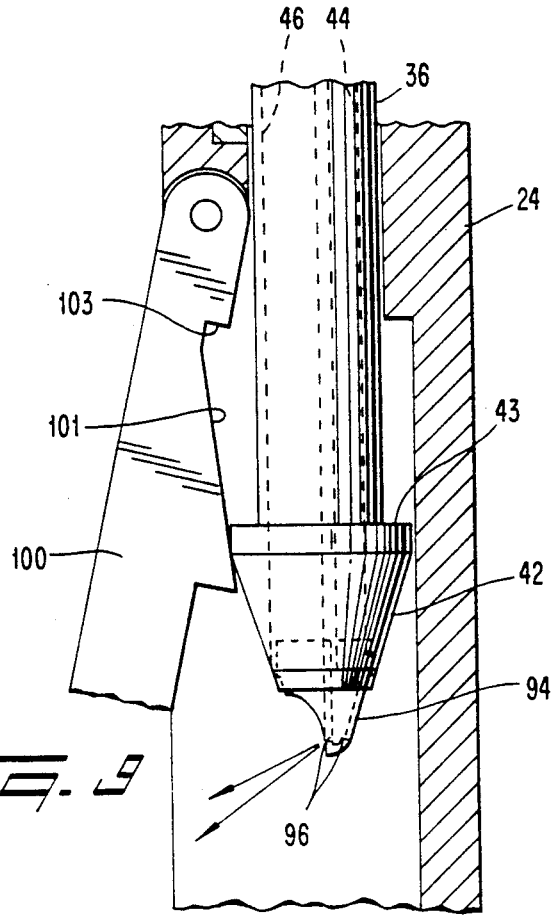
FIG. 9 is an enlarged cross-sectional view of a portion of the underreamer of the present invention showing the removable jet nozzle.

As best illustrated in FIG. 9, the jet flow passage 44 and the flow through passage 46 which extend through the wedge column 36 also extend into the conically shaped wedge area 42. A jet nozzle retainer 94 may be removably secured to the bottom end of the wedge area 42 for permitting alternative jet nozzle arrangements. The jet nozzle retainer 94 includes a plurality of jet nozzles 96, only two of which are shown in FIG. 9. Preferably, the number of jet nozzles 96 should be equal in number to the number of cutter arms mounted on the body. The jet nozzles 96 direct a fluid jet stream to the cutting area of each cutter arm. The jet nozzle retainer also includes a passage 98 that communicates with the flow through passage 46.

Turning back to FIG. 1, the underreamer includes a plurality of cutter arms 100 which are pivotally mounted to the bottom sub 24 of the body 22. In the preferred embodiment, the underreamer includes three cutter arms 100 which are equally spaced around the circumference of the body 22 at equal intervals of approximately 120°. For purposes of simplifying the drawing figures, only one of the cutter arms is illustrated. The cutter arms 100 include a lip 103 that interacts with the ledge 43 formed on the conically shaped wedge area 42 of the wedge column 36 for effecting retraction of the cutter arms 100 during upward movement of the wedge column 36.

As seen in FIGS. 1 and 8, each of the cutter arms 100 includes a cutter arm socket 102 which is positioned in a recess in the bottom sub 24 of the body 22. The cutter arm sockets 102 can be connected to the bottom sub 24 of the body 22 in any suitable manner such as through the use of two allen head cap screws 104. The cutter arm 100 is connected to the cutter arm socket 102 by a pivot pin 106 that permits the cutter arm 100 to pivot outwardly from the retracted position shown in FIG. 1 and 8 to an extended position. The bottom sub 24 of the body 22 is provided with openings for receiving the cutter arms 100 when they are in their retracted position.

A bit cone 108 is secured to the lower end of each cutter arm 100. A wide range of bit cones having ball or roller bearings can be utilized. Alternatively, sealed journal bearing bit cones can be utilized if desired.

Although not shown in the figures, the underreamer may be provided with an arrangement for maintaining the relative rotational alignment of the wedge column 36 with respect to the body 22. Such an arrangement can take the form of a pin or key mounted in the bottom sub 24 of the body 22 at a point between the cutter arm socket 102 and the jet stream restrictor valve plunger 90. The pin or key can extend inwardly toward the wedge column 36 and engage a longitudinally extending slot or keyway formed in the outer peripheral surface of the wedge column 36. As a result, the projection or key can slide along the slot or keyway as the wedge column 36 moves up and down. The pin or key extending from the bottom sub 24 of the body 22 should preferably extend in a direction perpendicular to the plane along which the section of FIG. 1 is taken.

The above-described arrangement can help maintain proper alignment of the jet nozzles 96 relative to the cutter arms 100 so that during operation of the underreamer, the jet stream flowing out of the jet nozzles 96 will be directed to the cutting area of the bit cones 108. Also, the foregoing arrangement helps prevent unnecessary strain on the jet stream restrictor valve plunger 90 during operation of the underreamer, thereby avoiding the possibility that the jet stream restrictor valve plunger 90 may be sheered off.

Having described the structural features of the indexing valve spool and the fluid flow control and mechanical actuation system of the present invention in the context of their use in conjunction with an underreamer, the operation of the underreamer will now be described. To begin operation, the top end of the top sub 30 of the body 22 is connected to the end of a drill string and the underreamer 20 is then inserted into a well bore. The cutter arms 100 are in the retracted position illustrated in FIG. 1 and consequently, the underreamer 20 can be easily inserted into the well bore. At this point, fluid is not being supplied to the bore 32 in the body 22 and consequently, the valve spool 64 is positioned in its uppermost position as seen in FIG. 1 due to the upward biasing force of the valve spool spring 82. Similarly, the actuator assembly 34 is positioned in its uppermost position as seen in FIG. 1 due to the upward biasing force of the main return spring 40.

To initiate the underreaming operation, fluid is supplied through the drill string to the bore 32 in the body 22. The fluid flows through the bore 58 in the main return spring mandrel 56 and into the bore 66 in the valve spool 64. Since the size of the bore 66 in the valve spool 64 is smaller than the size of the bore 58 in the main return spring mandrel 56, the valve spool 64 is urged downwardly in opposition to the biasing force of the valve spool spring 82.

As the valve spool 64 moves downwardly, it also rotates about its longitudinal axis as a result of the engagement between the spring-loaded locator balls 80 and the continuous groove 70 formed in the outer surface of the valve spool 64. In particular, the valve spool 64 will rotate in the counterclockwise direction as seen from above the spool (i.e., to the right as seen in FIG. 1) due to the helical groove portions 72, 74. After rotating approximately 180°, the valve spool 64 will contact the adaptor plate 48 secured to the top end of the wedge column 36. At this point, the bore 66 extending through the valve spool 64 will be in alignment with the jet flow passage 44 extending through the wedge column 36. The position of the valve spool 64 relative to the wedge column will be as seen in FIG. 7.

Since the jet flow passage 44 is somewhat restricted due to the fact that the jet flow restrictor valve plunger 90 extends into and intersects the jet flow passage 44, the alignment of the bore 66 with the jet flow passage 44 provides sufficient fluid flow restriction to cause a pressure build-up above the actuator assembly 34. Although the pressure build-up occurs primarily because of the restriction of the jet flow passage 44 by the jet flow restrictor valve plunger 90, the smaller size of the jet flow passage 44 relative to the size of the bore 66 extending through the valve spool 64 also contributes to the pressure build-up. The pressure build-up results in the downward movement of the actuator assembly 34 against the upward biasing force of the main return spring 40. As the actuator assembly 34 moves downwardly, the conically shaped wedge area 42 located at the bottom of the wedge column 36 also moves downwardly and its conically shaped outer surface interacts with the inner surfaces 101 of the cutter arms 100 to force the cutter arms 100 outwardly to the extended position. The downward movement of the actuator assembly can be seen in FIG. 7.

At the same time that the actuator assembly 34 is moving downwardly, fluid is flowing through the jet flow passage 44 and is exiting the jet nozzles 96. As the wedge column 36 moves downwardly, the jet stream restrictor valve plunger 90 also moves downwardly and slides along the guide surface 92. As the jet stream restrictor valve plunger 90 moves along the guide surface 92, it begins to retract from the jet flow passage 44 due to the force of the fluid flow in the jet flow passage 44 and the inclined nature of the guide surface 92.

Figure 7:
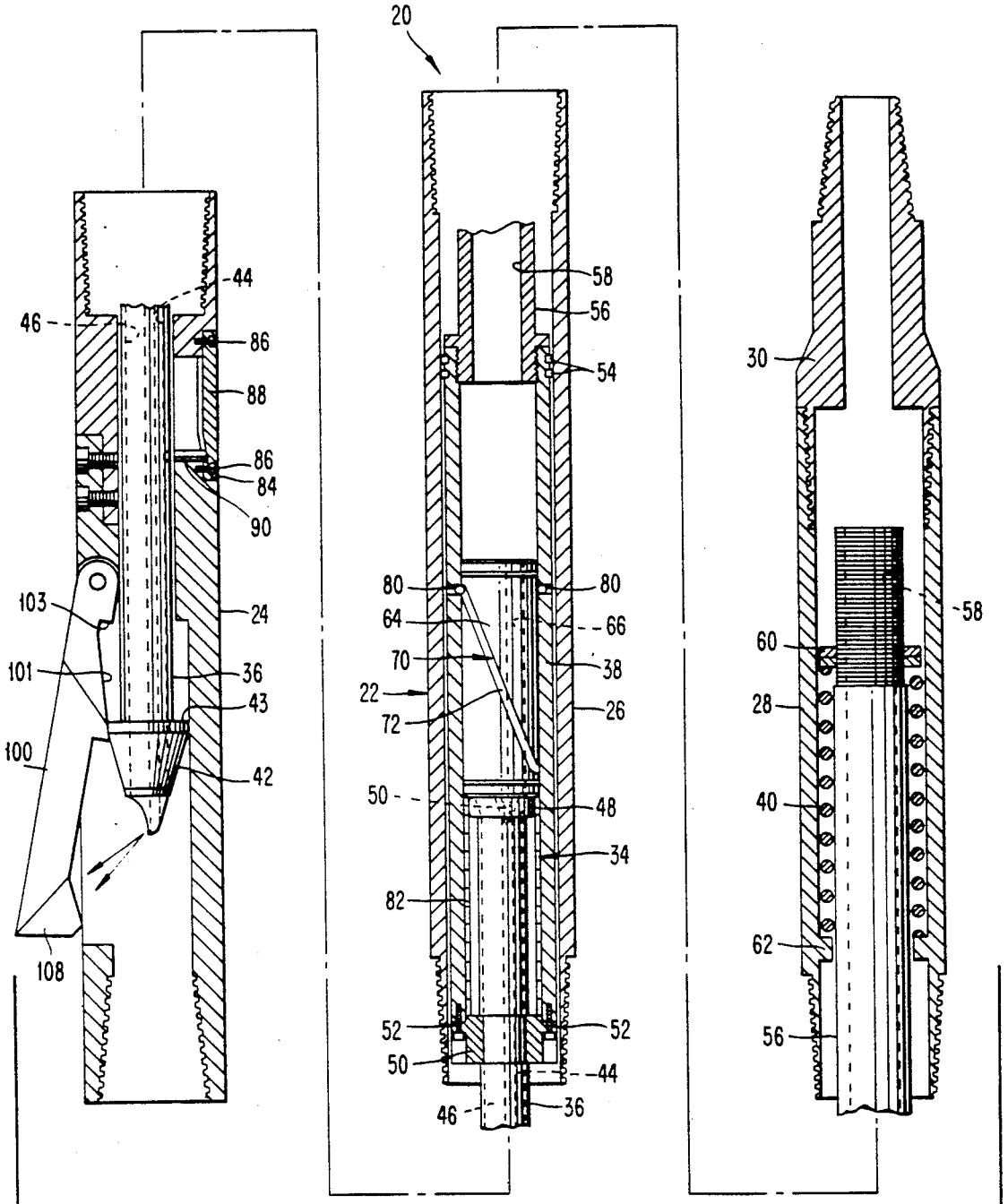
FIG. 7 is a longitudinal cross-sectional view of the underreamer according to the present invention illustrating the cutter arms in the extended position due to downward movement of the actuating assembly.

When the wedge column 36 has moved to its lowermost position with the cutter arms 100 in their fully extended position, the jet stream restrictor valve plunger 90 is fully retracted from the jet flow passage 44 as shown in FIG. 7 so that the jet flow restrictor valve plunger 90 does not restrict the flow of fluid through the jet flow passage 44. Thus, it can be readily seen that a substantial pressure drop will occur as the cutter arms 100 move from the retracted position to the extended position due to the retraction of the jet stream restrictor valve plunger 90 from the jet flow passage 44 as the wedge column 36 moves downwardly. As a result, assuming fluid is supplied to the underreamer at a substantially constant rate, servicing personnel at the surface can readily determine when the cutter arms 100 have reached their fully extended position by simply monitoring the pressure of the fluid in the underreamer.

In order to retract the cutter arms 100, the supply of fluid to the underreamer tool is interrupted. The interruption of the fluid supply causes the actuator assembly 34 to move upwardly as a result of the biasing force of the main return spring 40. Similarly, the valve spool 64 will move axially upwardly as result of the biasing force of the valve spool spring 82. The valve spool 64 will move axially upwardly with no rotational movement due to the interaction of the spring loaded locator balls 80 and the longitudinal groove portions 76, 78. As the actuator assembly 34 nears its uppermost position, the larger diameter end of the conically shaped wedge area 42 which forms a ledge 43 will contact the lip 103 formed on the cutter arms 100 and thereby force the cutter arms to pivot inwardly to their retracted position. The upward movement of the valve spool 64 will cease when the top of the valve spool 64 contacts the bottom end of the main return spring mandrel 56. Thus, the bottom end of the main return spring mandrel 56 serves as a stop for limiting the upward movement of the valve spool 64. Once the valve spool 64 and the actuator assembly 34 have reached their uppermost position, they will once again be positioned in the manner shown in FIG. 1, except that the valve spool 64 will be rotated 180° about its longitudinal axis from the position illustrated in FIG. 1.

When the supply of fluid to the underreamer 20 is restarted, the valve spool 64 will once again rotate and move downward as a result of the interaction of the spring-loaded locator balls 80 and the helical groove portions 72, 74 until the valve spool 64 comes into contact with the adapter plate 48. At this point, however the bore 66 extending through the valve spool 64 will be aligned with the flow through passage 46 extending through the wedge column 36. Since the size of the flow through passage 46 is larger than the size of the jet flow passage 44, the alignment of the bore 66 with the flow through passage 46 provides adequate relief of pressure above the actuator assembly 34 to prevent the downward motion required to extend the cutter arms 100. Thus, the alignment of the valve spool 64 with the flow through passage 46 allows the underreamer 20 to remain deactivated while circulation is maintained.

When the supply of fluid is once again interrupted the valve spool 64 will move upwardly with no rotational movement due to the interaction of the locator balls 8 and the longitudinal groove portions 76, 78. The valve spool 64 will move upwardly until it comes into contact with the bottom surface of the main return spring mandrel 56. The valve spool 64 will then be positioned as shown in FIG. 1.

From the foregoing description of operation, it can be readily seen that the valve spool 64 is mechanically programmed for two positions which are spaced apart 180° as a result of the pattern of helical and longitudinal groove portions formed on the outer surface of the valve spool 64. The two valve spool positions are designed to accomplish two purposes. First, to control the fluid flow to a straight-through flow route or to a flow route through a jet flow passage which is connected to jet nozzles and second, to translate the hydraulic back-pressure resulting when the valve spool is in the jet flow position into longitudinal motion and a mechanical force to cam open the underreamer cutter arms or conversely, to retract the arms when the pressure is released. The use of such an indexing valve spool permits the valve spool position, the resulting flow course of the fluid and the underreamer cutter arm action to be reliably controlled from the surface by controlling the circulating pump.

To provide an example of some of the dimensions of the various features of the fluid flow control and mechanical actuation system of the present invention, it has been found that a valve spool having an outside diameter of about 2.545 inches, a length of approximately 7.9 inches, a bore diameter of about 0.75 inches, and grooves that vary in depth from about 0.10 inches to about 0.145 inches provides good results. Also, in conjunction with such a valve spool, a valve spool cylinder having a bore diameter of approximately 2.585 inches was found suitable. It has also been determined that a pressure differential of approximately 700 psi can be achieved with a constant circulation rate of 2.7 BPM if the jet stream restrictor valve plunger 90 is designed to penetrate the jet flow passage 44 approximately 3/16 inches 5/16 inches when the wedge column 36 is in its uppermost position. That pressure differential of approximately 700 psi was found to be adequate to permit the operator at the surface to determine when the jet stream restrictor valve plunger 90 has been fully retracted from the jet flow passage, thereby indicating that the cutter arms 100 have reached the fully extended position.

Initial tests have also indicated that the underreamer according to the present invention is able to achieve an opening force on the cutter arm that is significantly greater than the opening force on the cutter arms of conventional underreamers. In particular, the underreamer of the present invention was able to achieve an opening force of approximately 2500 pounds at a pump rate of 2.7 BPM with the cutter arms in the fully collapsed position and an opening force of approximately 5000 pounds at a pump rate of 2.7 BPM with the cutters in the fully extended position.

It may be possible, depending upon the particular type of tool with which the fluid flow control and mechanical actuation system of the present invention is utilized, to employ the flow through passage in the wedge column as a means for accessing areas in the well bore located beneath the down-hole tool with, for example, wireline tooling.

Although the valve spool has been described above in connection with an underreamer, it is to be understood that the valve spool could be designed for other applications by varying the pattern of the helical and longitudinal groove portions formed on the outer surface of the valve spool to obtain programs of 2, 3, 4, or more positions with the position stops spaced apart at any variety of rotational angles. The off-center bore extending through the valve spool could be used to direct fluid flow to several different flow routes.

Also, the longitudinal stroke and the rotational action of the valve spool can be designed to mechanically operate features of many different down-hole tools. For example, the change of the fluid flow path can be designed to develop hydraulic back-pressure to hydraulically operate pistons for mechanically activating down-hole tool functions. A valve spool according to the present invention that provides both rotational and longitudinal movement and that can be designed to control fluid flow routes offers a multitude of options for the fluid flow control and mechanical operation of down-hole tools.

Examples of different types of down-hole tools in which the valve spool of the present invention can be utilized include turbo drills, down-hole motors, reversing tools, whip stock anchors, kick-off tools, back-off tools, side-wall coring tools, multi-stage cementing tools, cement retainers, liner setting tools, packer setting tools, tubing on-off tools, hold down tubing anchors, packer hold down tools, anchor packers, hook wall packers, hydraulic packers, inflatable packers, bridge plugs, tubing/casing cutters, overshot release tools, casing patch tools, tubing perforators, spears, fishing tools, pipeline pigs which can be employed in conjunction with other devices such as, for example, scrapers, brushes, inspection feelers, electrical inspection devices, as well as other tools. Depending upon the particular fluid flow control and mechanical actuation requirements of the specific down-hole tool, the valve spool can be readily designed to meet those needs.

It is also to be realized that the valve spool can be designed to be biased in the downward direction rather than in the upward direction as described above. Additionally, as an alternative to the use of a spring for biasing the valve spool upwardly or downwardly, the valve spool can be operated between the upward and downward positions by hydraulic pressure. Further, the valve spool can be designed to rotate on the upward stroke rather than the downward stroke as described above.

The principles, preferred embodiments, and modes of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations, changes and equivalents which fall within the spirit and scope of the present invention as defined in the claims be embraced thereby.

What is claimed is:

1. A hydraulically operated down-hole tool for use in well bores comprising:

a body having a longitudinal bore that extends therethrough:

a plurality of cutter arms mounted on a lower end of the body for movement between a retracted position and an extended position;

an axially movable wedge column positioned in the bore of the body, said wedge column having a longitudinal jet flow passage extending from one end of the wedge column to an opposite end and a flow through passage extending from the one end of the wedge column to the opposite end, said flow through passage and said jet flow passage being radially offset with respect to a longitudinal axis of the wedge column, said flow through passage being larger in size than said jet flow passage, said wedge column having engaging means for engaging the cutter arms upon downward movement of the wedge column to cause the cutter arms to pivot outwardly to the extended position, said engaging means being located at the bottom end of the wedge column; and rotationally and axially movable valve means positioned within the bore of the body and above the wedge column for alternately supplying fluid to the flow through passage and the jet flow passage and for translating hydraulic-back pressure which results when the valve means supplies fluid to the jet flow passage into downward axial movement of the wedge column to cause the cutter arms to pivot outwardly to the extended position.

2. The down-hole tool according to claim 1, wherein said body includes a bottom sub to which are pivotally mounted the cutter arms, a middle sub connected to the bottom sub, a main return spring sub connected to the middle sub, and a top sub connected to the main return spring sub, said wedge column including a conically-shaped wedge portion which defines said means for engaging the cutter arms, said wedge column extending from the bottom sub into the middle sub.

3. The down-hole tool according to claim 2, including an axially movable valve spool cylinder located within the bore in the body, said valve spool cylinder having a bore extending longitudinally therethrough, said wedge column extending into the bore in the valve spool cylinder, and including connecting means for connecting the valve spool cylinder to the wedge column so that the valve spool cylinder and the wedge column move as a single unit.

4. The down-hole tool according to claim 3, wherein said valve means includes a cylindrically-shaped valve spool having a bore extending longitudinally therethrough, the bore in said valve spool being radially offset with respect to and substantially parallel to a longitudinal axis of the valve spool, said valve spool being axially and rotationally positioned within the valve spool cylinder at a point above an upper end of the wedge column, and including indexing means for causing the valve spool to simultaneously rotate and move axially downwardly when fluid is supplied through the top sub and to move axially upwardly without rotation when the supply of fluid is interrupted.

5. The down-hole tool according to claim 4, wherein said indexing means includes a continuous groove formed on the outer surface of the valve spool and two spring-loaded balls positioned on opposite sides of the bore in the valve spool cylinder which engage the groove on the valve spool.

6. The down-hole tool according to claim 5, wherein the groove formed on the outer peripheral surface of the valve spool includes two helically extending groove portions which are connected to each other at their ends by longitudinally extending groove portions, each of said helically extending groove portions extending around substantially one-half of the circumference of the valve spool.

7. The down-hole tool according to claim 4, including a valve spool spring positioned between said connecting means and a bottom end surface of the valve spool for normally biasing the valve spool upwardly, and stop means connected to an upper end of the valve spool cylinder for limiting the upward movement of the valve spool caused by the valve spool spring.

8. The down-hole tool according to claim 7, wherein said stop means includes a main return spring mandrel connected to the upper end of the valve spool cylinder and extending upwardly within the bore in the body into the main return spring sub, said main return spring mandrel having a bore extending longitudinally therethrough, and including a shoulder extending inwardly from an inner surface of the bore in the body, an adjustable spring retainer threadably connected to an outer surface of the main return spring mandrel at an upper end thereof and a main return spring surrounding the main return spring mandrel, said shoulder being positioned in the main return spring sub and said main return spring being positioned between said spring retainer and said shoulder.

9. The down-hole tool according to claim 3, including a restrictor bore which extends into the wedge column and intersects the jet flow passage and a jet stream restrictor valve plunger slidably positioned in said restrictor bore for restricting the flow of fluid through the jet flow passage, an end of said jet stream restrictor valve plunger located remote from said jet flow passage contacting a surface which has an inclined portion that is inclined away from the jet flow passage to permit the jet stream restrictor valve plunger to be retracted from the jet flow passage as the wedge column moves downwardly.

10. The down-hole tool according to claim 2, including a jet spray nozzle removably secured to the conically-shaped wedge portion of the wedge column.

11. A hydraulically operated down-hole tool for use in well bores comprising:

a body having a longitudinal bore extending therethrough;

a plurality of cutter arms mounted on a lower end of the body for movement between a retracted position and an extended position;

an axially movable actuator assembly positioned in the bore in the body for activating the cutters between the extended position and the retracted position; and a cylindrically-shaped valve spool slidably positioned within the body, said valve spool having a bore extending longitudinally therethrough that is radially offset with respect to a longitudinal axis of the valve spool, said valve spool having a groove formed on the outer surface thereof for interacting with at least one ball mounted on the actuator assembly to cause the valve spool to rotate and move axially downwardly when fluid is supplied to the body and to cause the valve spool to move axially upward without rotation when the supply of fluid is interrupted, the fluid flow to the actuator assembly being controlled, and said controlled fluid flow actuating the cutter arms.

12. The down-hole tool according to claim 11, wherein said actuator assembly includes a wedge column slidably mounted within the bore in the body, said wedge column having a jet fluid passage extending from one end of the wedge column to an opposite end thereof and a flow through passage extending from the one end of the wedge column to the opposite end thereof, said jet flow passage and said flow through passage being radially offset with respect to a longitudinal axis of the wedge column.

13. The down-hole tool according to claim 12, wherein said actuator assembly includes a valve spool cylinder positioned within the bore in the body, said valve spool cylinder having a bore extending therethrough, said wedge column extending into the bore in the valve spool cylinder and being connected to said valve spool cylinder so that said wedge column and said valve spool cylinder move together with one another.

14. The down-hole tool according to claim 13, including a main return spring mandrel connected to a top end of the valve spool cylinder, an adjustable spring retainer threadably connected to an upper end of the main return spring mandrel, and a shoulder extending inwardly from an inner surface of the bore in the body, said actuator assembly including a main return spring positioned within the body between the spring retainer and the shoulder for biasing the wedge column and the valve spool cylinder upwardly.

15. The down-hole tool according to claim 13, including a valve spool spring positioned within the bore in the valve spool cylinder for biasing the valve spool upwardly.

16. The down-hole tool according to claim 12, including a restrictor bore which extends into the wedge column and intersects the jet flow passage and a jet stream restrictor valve plunger slidably positioned in said restrictor bore, an end of said jet stream restrictor valve plunger located remote from said jet flow passage contacting a surface which has a portion that is inclined away from the jet flow passage to permit the jet stream restrictor valve plunger to be retracted from the jet flow passage as the wedge column moves downwardly.

17. The down-hole tool according to claim 12, wherein said wedge column includes a conically shaped wedge area located at a lower end of the wedge column for engaging inwardly facing surfaces of the cutter arms to move the cutter arms outwardly to the extended position upon downward movement of the wedge column.

18. The down-hole tool according to claim 11, wherein said groove formed on the outer surface of the valve spool is a continuous groove that includes two helical groove portions which extend around substantially one-half of the circumference of the valve spool and which are connected to one another at their ends by two longitudinally extending groove portions that extend substantially parallel to the longitudinal axis of the valve spool.

19. A fluid flow control system and mechanical actuation system for controlling fluid flow and mechanically actuating a down-hole tool, comprising:

actuating means being movable for actuating a tool upon movement of the actuating means in a first direction, said actuating means being biased in a second direction, said actuating means having first and second passages extending through one part thereof and having a bore extending through another part thereof; and valve means positioned in the bore in the actuating means and being axially and rotationally movable, said valve means having a bore extending therethrough that is radially offset with respect to a longitudinal axis of the valve means for controlling fluid flow to the two passages individually upon successive strokes of the valve means, the supply of fluid at a predetermined pressure to the bore in the valve means causing a pressure build-up to occur when the bore in the valve means is aligned with one of the passages, said pressure build-up being sufficient to cause the actuation means to move in the first direction, the supply of fluid to the bore in the valve means at said predetermined pressure preventing said pressure build-up to occur when the bore in the valve means is aligned with the other passage, the prevention of said pressure build-up causing said actuating means to remain biased in the second direction.

20. The system according to claim 19, including spring means for normally biasing the valve means upwardly.

21. The system according to claim 20, wherein said valve means includes a cylindrical valve spool having a continuous groove formed on an outer surface thereof for interacting with a ball so that when fluid is supplied to the bore in the valve spool, the valve spool simultaneously rotates and moves downward against the biasing force of the spring means and so that upon interruption of the fluid to the bore, the valve spool moves upward without rotation due to the biasing force of the spring means.

22. The system according to claim 19, wherein said actuating means includes a wedge column through which said first and second passages extend, both of said passages being radially offset with respect to a longitudinal axis of the wedge column, said first passage having a smaller diameter than said second passage.

23. The system according to claim 22, wherein said actuating means includes a valve spool cylinder through which said bore in the actuating means extends, said valve spool being positioned in the bore in the valve spool cylinder.

24. A method of controlling fluid flow and mechanically actuating a down-hole tool comprising the steps of:

supplying fluid to a valve which has a bore extending therethrough to cause the valve to move from a first position to a second position against a biasing force of a valve spring so that the bore in the valve is in alignment with a first passage in an actuator assembly;

causing a build-up of pressure sufficient to cause the actuator assembly to move in a first direction to actuate a tool;

interrupting the supply of fluid to the valve to cause the valve to move from the second position to a third position as a result of the biasing force of the valve spring;

supplying fluid to the valve to cause the valve to move from the third position to a fourth position against the biasing force of the valve spring so that the bore in the valve is in alignment with a second passage in the actuator assembly; and preventing a build-up of pressure sufficient to move the actuator assembly in the first direction so that fluid flows through the second passage while said actuator assembly remains substantially stationary.

25. The method according to claim 24, wherein fluid is supplied to said valve at a predetermined rate to move said valve from the first position to the second position and to cause the build-up of pressure, the fluid being supplied to the valve at said predetermined rate to move the valve from the third position to the fourth position while preventing a build-up of pressure.

26. The method according to claim 24, wherein said valve undergoes rotational and axial movement as it moves from the first position to the second position and from the third position to the fourth position, said valve undergoing axial movement without rotational movement as it moves from the second position to the third position.

27. A down-hole tool for use in well bores comprising:

a body having a bore extending therethrough;

a plurality of cutter arms pivotally mounted on the body for movement between an extended position and a retracted position;

actuator means movably positioned in the bore in the body for actuating the cutter arms from the retracted position to the extended position upon downward axial movement of the actuator means caused by a fluid circulating pressure, said actuator means having two passages extending therethrough, one of said passages having a smaller diameter than the other passage, and means for producing a reduction in the fluid circulating pressure as the cutter arms move from the retracted position to the extended position while a substantially constant pump rate of fluid is maintained to permit an operator to determine when the cutter arms have reached a fully extended position.

28. The down-hole tool according to claim 27, wherein said actuator means includes a wedge column through which said two passages extend.

29. The down-hole tool according to claim 28, wherein said means for producing a significant reduction in the fluid circulating pressure includes a restrictor bore that extends into the wedge column and that intersects the passage having the smaller diameter and a jet stream restrictor valve plunger slidably positioned in said restrictor bore, an end of said jet stream restrictor valve plunger located remote from said wedge column contacting a surface that has a portion which is inclined away from the wedge column to permit the jet stream restrictor valve plunger to be retracted from the smaller diameter passage as the wedge column moves downwardly.

30. The system according to claim 19, wherein said valve means includes a valve spool having a continuous groove formed on its outer peripheral surface.

31. The system according to claim 30, wherein said actuating means includes a valve spool cylinder through which said bore extends, said valve spool being positioned in said valve spool cylinder and an inner surface of the valve spool cylinder having a least one spring-loaded locator ball positioned therein which engages the groove formed on the outer peripheral surface of the valve spool.

32. The system according to claim 30, wherein said groove includes a plurality of generally helically extending groove portions which are connected together at their ends by generally longitudinally extending groove portions.

* * * * *